US009382677B2

(12) United States Patent
Hofmann

(10) Patent No.: US 9,382,677 B2
(45) Date of Patent: Jul. 5, 2016

(54) MARKINGS OF HIGHLY VISCOUS MATERIAL ON A SURFACE

(71) Applicant: Hoffmann GmbH Maschinenfabrik und Vertrieb, Rellingen (DE)

(72) Inventor: Jan Philipp Hofmann, Hamburg (DE)

(73) Assignee: Hofmann GmbH Maschinenfabrik und Vertrieb, Rellingen (DE)

( * ) Notice: Subject to any disclaimer, the term of this patent is extended or adjusted under 35 U.S.C. 154(b) by 150 days.

(21) Appl. No.: 14/083,613

(22) Filed: Nov. 19, 2013

(65) Prior Publication Data

US 2014/0147581 A1 May 29, 2014

(30) Foreign Application Priority Data

Nov. 29, 2012 (DE) ..... 10 2012 221 834

(51) Int. Cl.
*E01C 23/24* (2006.01)
*E01C 23/22* (2006.01)

(52) U.S. Cl.
CPC ..... *E01C 23/222* (2013.01); *E01C 23/24* (2013.01)

(58) Field of Classification Search
USPC ..... 404/108, 110, 111
IPC ..... E01C 19/45,23/22, 23/222, 23/24, E01C 23/243
See application file for complete search history.

(56) References Cited

U.S. PATENT DOCUMENTS 3,960,326 A * 6/1976 Nishiumi ..... B05B 3/02 118/DIG. 16
4,011,993 A * 3/1977 Mizuno ..... E01C 23/22 118/308
4,453,856 A * 6/1984 Chiostri ..... E01C 23/065 404/108
5,279,500 A * 1/1994 Perrin ..... E01C 19/176 404/111
5,324,136 A * 6/1994 Reymonet ..... E01C 19/48 404/107
6,071,040 A * 6/2000 Macku ..... E01C 19/48 404/108
7,186,055 B2 * 3/2007 Lee ..... E01C 19/405 404/101

FOREIGN PATENT DOCUMENTS

| | | |
|---|---|---|
| DE | 10012117 | 10/2001 |
| DE | 10145428 | 4/2003 |
| DE | 102009045576 | 4/2011 |
| EP | 0665062 | 1/1995 |

OTHER PUBLICATIONS

German Search Report, Aug. 21, 2013.

* cited by examiner

*Primary Examiner* — Gary Hartmann
(74) *Attorney, Agent, or Firm* — Greer, Burns & Crain Ltd.

(57) ABSTRACT

A method and device for creating markings of highly viscous marking material on a surface, in particular a road surface. The marking material is discharged from a material supply and, before striking the surface is fed to a rotational body, which moves relative to the surface in a longitudinal direction of the marking, and is applied to the surface divided into unequal material portions by the rotational body. The rotational body axis of rotation runs at right angles to the marking longitudinal direction. The marking material is fed to the rotational body in a plurality of marking material flows, which, viewed in a longitudinal direction of the rotational body, are discharged next to one another from a plurality of discharge nozzles continuously, pulsatingly or intermittently in a pressurized manner. The individual marking material flows are turned on or off in accordance with the marking to be created.

15 Claims, 6 Drawing Sheets

MARKINGS OF HIGHLY VISCOUS MATERIAL ON A SURFACE

CROSS-REFERENCES TO RELATED APPLICATIONS

This application claims the benefit of the German patent application No. 10 2012 221 834.3 filed on Nov. 29, 2012, the entire disclosures of which are incorporated herein by way of reference.

BACKGROUND OF THE INVENTION

The invention relates to a method for creating markings, in particular marking lines of highly viscous marking material, in particular a two-component cold plastic, on a surface, which is to be marked, in particular a road surface, wherein the marking material is discharged from a material supply and, before striking the surface, which is to be marked, is fed to a rotational body, which moves relative to the surface in longitudinal direction of the marking, which is to be created, and is applied to the surface so as to be divided into unequal material portions by means of said rotational body, wherein the axis of rotation of the rotational body runs at right angles to the longitudinal direction of the marking and wherein the marking material is fed to the rotational body in the form of a plurality of marking material flows, which, viewed in longitudinal direction of the rotational body, are discharged next to one another.

In addition, the invention relates to a device for creating markings, in particular marking lines of highly viscous marking material, in particular a two-component cold plastic, on a surface, which is to be marked, in particular a road surface, comprising at least one material storage container, comprising at least one conveying device for conveying marking material from the material storage container to a material outlet and comprising a rotational body, which is arranged below the material outlet and through which marking material, which flows from the material outlet, can be divided into unequal material portions and can be applied to the surface, wherein, during operation, the device can be moved relative to the surface in longitudinal direction of the marking, which is to be created, and wherein the axis of rotation of the rotational body runs at right angles to the longitudinal direction of the marking and wherein the marking material can be fed to the rotational body in the form of a plurality of marking material flows, which, viewed in longitudinal direction of the rotational body, flow next to one another.

Structured markings of unequal material portions, thus comprising a stochastic material distribution, encompass increased traffic safety, in particular in the dark and in response to wetness, because rain water can drain and individual areas of the marking protrude from the water film on the road surface. The light from automobile headlights is reflected better through this. In addition, a lower noise development when driving over such markings is advantageous as compared to markings of equal material drops, which are arranged regularly. In the case of markings comprising a stochastic material distribution, the risk that the marking material comes loose when a snowplow drives over it, is also small.

A method and a device of the above-mentioned type are known from document EP 0 665 062 A1. This document shows a device on a vehicle for marking the road by means of color drops. The device has a storage container for color mass, which, on the bottom, encompasses an outlet gap, to which a guide plate, which runs diagonally to the bottom area of the storage container and on which a laminar flow of the color mass takes place, connects. On its bottom edge, the guide plate is provided with notches, which ensure that a plurality of color mass partial flows is created, when the vehicle moves in operating direction. A turbine roller comprising blades for creating an air flow, which acts on the color mass partial flows that drain from the guide plate, is located below the bottom of the storage container. This air flow divides the color mass into color drops and accelerates the color drops, which are flung onto the road surface with great force.

It is considered to be a disadvantage in this state of the art that the volume flow of the color mass from the open storage container through the outlet gap strongly depends on the level of the color mass in the open storage container and fluctuates with this level. The material viscosity, which also fluctuates due to temperature changes, also influences the discharged color mass quantity. As a result, the quantity of the color mass, which is discharged for each unit of stretch of road, which the vehicle covers, is not constant. This leads to irregular road markings, which means a reduced quality. In addition, the marking speed, which can be reached, is limited, because the color mass is dispensed from the storage container solely by means of the force of gravity. This state of the art furthermore encompasses the disadvantage that the marking process needs to be interrupted at relatively short intervals as a function of the hardening time of the marking material, so as to clean the device parts touched by the marking material, in particular the storage container and the guide plate. This means lower daily outputs and a high flushing fluid consumption, which leads to high costs and to environmental pollution. In the case of the slot-shaped material outlet, the material flow can furthermore be hindered easily, e.g. because clumps get caught in the slot, which requires a relatively frequent cleaning of the outlet.

A further method and a device for the above-mentioned purpose are known from document CH 681 904 A5. The device forms an open system herein, comprising a draw box comprising a slot-shaped material outlet and comprising a rotational body arranged therebelow, here in the shape of a roller made of a material having a low adhesiveness. When producing the marking, the marking material, which flows out in the form of a thin curtain, is divided into a plurality of unequally large and irregularly shaped material portions by means of the rotating rotational body, prior to striking the surface, which is to be marked. Structured markings comprising a stochastic material distribution can be created in this manner.

In addition to the above-mentioned disadvantages, this state of the art encompasses the further disadvantage that the marking material, which is applied herein in the form of a flat belt or curtain, has the characteristic that, due to acceleration caused by the force of gravity and wall friction at the outlet walls, the material flow is constricted after leaving the slot-shaped outlet prior to striking the rotational body. The effect of constriction is a function of the material viscosity, among others, which also fluctuates due to temperature changes, and of the type and number of the fillers and solids, which are added to the marking material. As a result, the line width of the marking line is thus always smaller than the slot width of the outlet to an extent, which cannot be determined accurately ahead of time.

A further device is known from document EP 0 148 494 A2. Drops made of marking material are discharged from gap-shaped outlets, which are oriented substantially horizontally and which are arranged next to one another and which are separated from one another by means of separating walls, and are spun onto the surface, which is to be marked, by means of a rotating paddle arrangement. The axis of rotation of the paddle arrangement is thereby located at the same height as the outlets. Marking lines of individual material drops, which are largely identical, can be created with this.

It is considered to be disadvantageous in the case of this state of the art that the marking material, which adheres to the separating walls and which hardens at that location, can relatively easily lead to impairments of the movement of the rotating paddles. A cleaning of the relatively narrow outlets is difficult and time-consuming. Structured markings comprising a stochastic material distribution cannot be created by means of this device.

A device for creating marking lines, which consist of a plurality of individual marking material portions, is known from document DE 10 2009 045 576 A1. The marking material portions herein can be ejected from a nozzle arrangement, which is connected to a marking material source and which comprises a plurality of discharge nozzles, which are arranged at right angles to a direction of movement of the device, by means of blasts of compressed air. Marking lines of individual material drops, which are largely identical, can be created with this, whereas structured markings comprising a stochastic material distribution, however, cannot be created with this.

The instant invention thus has the task of creating a method and a device of the above-mentioned type, which avoids the specified disadvantages and which makes it possible to produce structured markings comprising a stochastic material distribution, of high quality and in a highly cost-efficient manner.

SUMMARY OF THE INVENTION

The part of the task, which relates to the method, can be solved according to the invention by means of a method of the above-mentioned type, which is characterized in that the marking material is discharged from a plurality of discharge nozzles continuously or so as to pulsate or intermittently in a pressurized manner and that the individual marking material flows are turned on or off in accordance with the marking, which is to be created.

Advantageously, the plurality of marking material flows is less susceptible to interferences caused by clumping or foreign objects in the marking material as a single thin band-shaped or curtain-shaped marking material flow, whereby the appearance of interferences and interruptions is rarer. Due to the plurality of marking material flows, which are discharged next to one another, the impact of the material viscosity on the line width of the marking line is also considerably lower than in the case of a band-shaped or curtain-shaped material flow. The method according to the invention can thereby advantageously be carried out in a closed system without the known, above-mentioned disadvantages of open systems comprising draw or feed boxes, which avoids a hardening of marking material prior to being discharged onto the surface, which is to be marked. The fact that the marking material is discharged continuously or so as to pulsate or intermittently from a plurality of discharge nozzles in a pressurized manner will contribute to a reliable process flow. In addition, a high speed can be reached in response to the production of the markings in this manner. Due to the fact that the individual marking material flows are turned on or off in accordance with the marking, which is to be created, the width of a marking, which is to be created, can in particular be changed in a simple manner.

The number of the discharged marking material flows depends in particular on the width of the marking, which is to be created, and can be varied in accordance thereto. Advantageously, the distance between two adjacent marking material flows relative to one another is chosen such that an impact of the individual material flows can be identified in the created marking, thus that an even material distribution is attained in cross direction of the marking.

Preferably, provision is further made for the method according to the invention that the marking material flows are fed to the rotational body with a round or oval or square or rectangular material cross section. A low sensitivity against clumping or foreign objects, which might be contained in the marking material, can be attained by means of these cross sections as compared to a single very wide and thin material cross section according to the above-mentioned state of the art, which boosts an interruption-free process flow.

Finally, provision is made for the method according to the invention that a first connected group of the marking material flows is guided to a first rotational body and/or that a second connected group of the marking material flows is guided to a second rotational body, which can be rotated independent from the first rotational body. In this manner, it is not only possible to create individual lines by means of the method according to the invention, but double lines and combined lines can also be created advantageously in one operation cycle. A high operating speed and an accurate and constant distance of the individual marking lines of the double lines or combined lines is reached hereby, which cannot be reached on practice when creating the lines successively. Due to the fact that the individual discharge nozzles can be turned on and off independent from one another, the parallel lines can be created independent from one another; for example, a continuous first line, to which a second, broken line is created in parallel, can thus be created in one operation cycle.

The solution of the second part of the task, which relates to the device, can be solved according to the invention by means of a device of the above-mentioned type, which is characterized in that the material outlet is formed by means of a plurality of outlet openings, which, viewed in longitudinal direction of the rotational body, are arranged next to one another, that the outlet openings are discharge nozzles, through which the marking material can be discharged continuously or so as to pulsate or intermittently in a pressurized manner, and that the individual outlet openings can be released or locked in accordance with the marking, which is to be created.

The advantages concerning low susceptibility to interference, cost-efficient operation and high quality of the created markings, which have already been explained above in context with the method according to the invention, are attained by means of the device according to the invention. In particular, a high operating speed is ensured, because the outlet openings are discharge nozzles, through which the marking material can be discharged continuously or so as to pulsate or intermittently in a pressurized manner. Due to the fact that the individual outlet openings can be released or locked in accordance with the marking, which is to be created, the width of the created marking can be changed quickly and easily as required.

For the purpose of a low sensitivity against clumping and/or foreign objects in the marking material, the outlet openings preferably have a round or oval or square or rectangular cross section.

So as to be able to not only produce individual lines, but also double lines and/or combined lines in a particularly cost-efficient manner by means of the device according to the invention, it is proposed for a first rotational body to be arranged below a first connected group of the outlet openings and for a second rotational body, which can be rotated independent from the first rotational body, to be arranged below a second connected group of outlet openings. In response to the production of combined lines, the corresponding rotational body can in each case be stopped in line gaps, so that the marking material residues, which are still located on the rotational body, are prevented from being slung off in the line gap as far as possible. In the case of double lines and combined lines, an accurately defined distance between the two marking lines, which are located next to one another, is always ensured due to the simultaneous creation thereof.

In a further embodiment, its own, individually controllable rotary drive, preferably in each case a hydraulic motor, is assigned to each rotational body. Either both rotational bodies or only one of the two rotational bodies can be set into rotation with this, depending on the respective need. In addition, the speed of the rotational bodies can be changed and can be set appropriately due to the controllability, so as to attain a desired structure of the marking. In addition, each rotational body can be stopped individually, as required.

Advantageously, the outer periphery of the/each rotational body is provided with structural elements, it is preferably formed by means of a spiked roller.

To be able to influence the effect, which the/each rotational body has on the marking material flows, which strike it, provision is advantageously made for the position of the/each rotational body to be capable of being adjusted relative to the material outlet, preferably in a horizontal direction parallel to the direction of movement of the device and/or to be capable of being displaced in a vertical direction or to be capable of being pivoted in a vertical plane.

To be able to quickly and easily adapt the device to different needs, in particular to different marking widths, provision is made for the individual discharge nozzles to be located in individual nozzle elements, which can be attached to a nozzle support and which can be removed from the nozzle support and which form a variable nozzle arrangement. Clogging caused by hardened material can also be removed much easier in this manner than in the case of a single slot-shaped material outlet by removing or replacing individual nozzle elements.

The above-mentioned release and locking of the individual outlet openings takes place, for example, by displacing or twisting the individual nozzle elements within the nozzle arrangement, whereby two marking material channel sections of a marking material channel, which leads to the respective nozzle element, can be made to overlap or not to overlap. This arrangement also allows for a simple flushing of the nozzle element by means of a flushing fluid, which is fed through the marking material channel, with a small amount of flushing effort, because, if needed, the flushing fluid and a maximum flushing fluid pressure can be applied separately to the individual nozzle elements in each case.

A further technical possibility for adapting the device to different applications is that the individual nozzle elements can preferably be assembled at a changeable lateral distance to one another so as to form the nozzle arrangement.

The conveying device of the device is preferably formed by means of at least one metering pump. Advantageously, the device forms a closed system, in the case of which, in combination with the metering pump, the discharged marking material quantity can be controlled as a function of the distance, so as to ensure a steady layer thickness of the created marking in response to speed changes of the device relative to the surface, which is provided with markings. In addition, an accurate doubling of the discharged material quantity is possible in the closed system in combination with the metering pump in the case of double lines or combined lines, in that the output of the metering pump is doubled accordingly.

In addition to the metering pump or also instead of the metering pump, a printing medium source can be used as conveying device, which creates an a pressure cushion of a pressure medium, such as air, above the material level in a closed material storage container, so as to convey the marking material. In the case of two-component marking material, the basic component thereof, for example, which comprises the larger volume flow, can be conveyed by means of a pressure medium, and the second component of which, in particular a hardener comprising the smaller volume flow, can be conveyed by means of a metering pump.

An advantageous embodiment of the device according to the invention finally provides for the rotational body/bodies including a rotational body support and, if applicable, one or a plurality of rotational body drives to be embodied as an additional unit, which can be mounted to the remaining device and which can be separated from the remaining device. In this embodiment, the device can be modified quickly and easily between two different versions, wherein, in the first version without the rotational body/bodies, markings can be created, which consist of a plurality of marking material points, which are relatively identical, while in the second version comprising the rotational body or the rotational bodies, markings comprising a stochastic material distribution can be created. The change between the two versions of the device can thereby be realized with little modification effort. In addition, the relatively low acquisition costs and the small expenditure of time for the modification are advantageous, when, in the case of a device, which is already at hand, only the additional unit must be acquired for creating markings of uniform marking materials points, so as to then also be able to create markings comprising a stochastic material distribution. For example, the version of the device, which was mentioned first above, can be embodied according to DE 10 2009 045 576 A1 by applicant, to which reference is made herein.

BRIEF DESCRIPTION OF THE DRAWINGS

Exemplary embodiments of the invention will be explained hereinbelow by means of a drawing.

In the drawing.

DETAILED DESCRIPTION OF THE PREFERRED EMBODIMENTS

Figure 1:
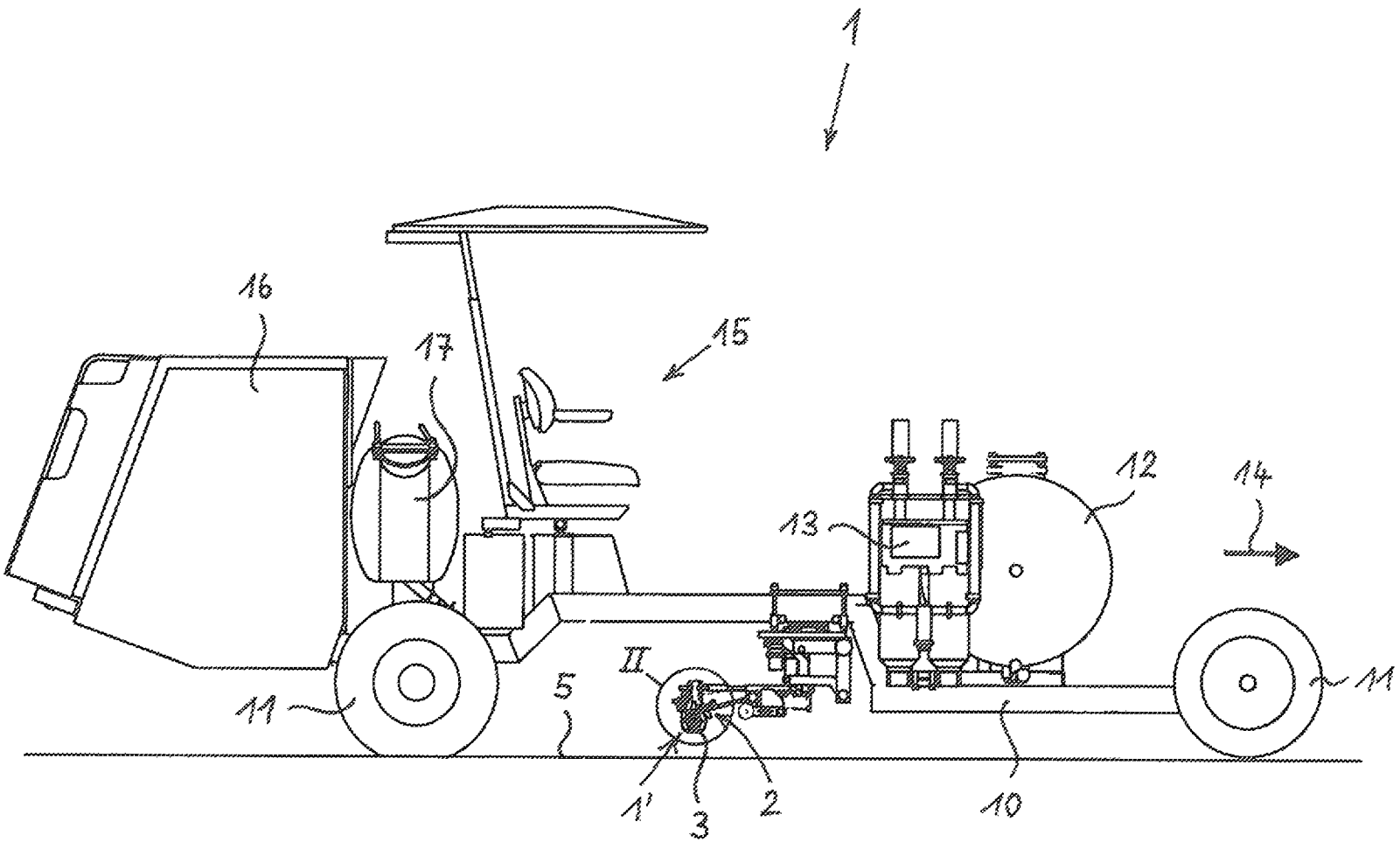
FIG. 1 shows a device for creating markings on a surface, which is to be marked, in a schematic side view.

FIG. 1 of the drawing shows a device 1 for creating markings on a surface 5, which is to be marked, in a schematic side view. The device 1 is embodied herein as a self-propelled vehicle comprising a frame 10 and four wheels 11, as well as with a drive unit 16, such as an internal combustion engine and transmission arranged on the rear, and comprising a driver's cab 15 for an operator. In the alternative, the device 1 can also be embodied as a pulled vehicle without its own propulsion.

In the front part of the device 1, on the right-hand side in FIG. 1, at least one storage container 12 for marking material is arranged on the frame 10. A conveying device 13, here a metering pump, which, on the input side, is connected to the interior of the storage container 12 via lines, which are not visible herein, and which, on the output side, is connected to a material outlet 2 for discharging marking material to the surface 5, which is to be marked, such as a road surface, is connected downstream from the storage container 12. The material outlet 2 is fastened to the bottom side of the frame 10 and is at a predeterminable distance above the surface 5. In cross direction of the device 1, that is, viewed vertically to the drawing plane of FIG. 1, the material outlet 2 consists of a number of separate outlet openings, which are arranged next to one another and which cannot be seen individually herein.

A rotational body 3, which can be set into rotation and the outer periphery of which is provided with structural elements, is arranged below the material outlet 2.

During operation of the device 1, the latter moves across the surface 5, which is to be provided with a marking, in the direction of movement 14, which is illustrated by means of the arrow. The conveying device 13 thereby conveys a predeterminable dosage of marking material from the storage container 12 to the material outlet 20 and to the individual outlet openings thereof, through which the marking material initially falls down freely in the form of a plurality of parallel material flows and then hits the rotational body 3, which is set into rotation, after covering a short distance. The material flows of the marking material, which hit the rotational body 3, are divided into irregular and uneven material portions and are conveyed to the surface 5, which is provided with a marking, by means of the structural elements attached thereto.

Glass beads can be removed from a further storage container 17, which is arranged in the rear part of the device 1, and can be poured onto the surface of the marking, which has not yet hardened, as it is known per se.

Figure 2:
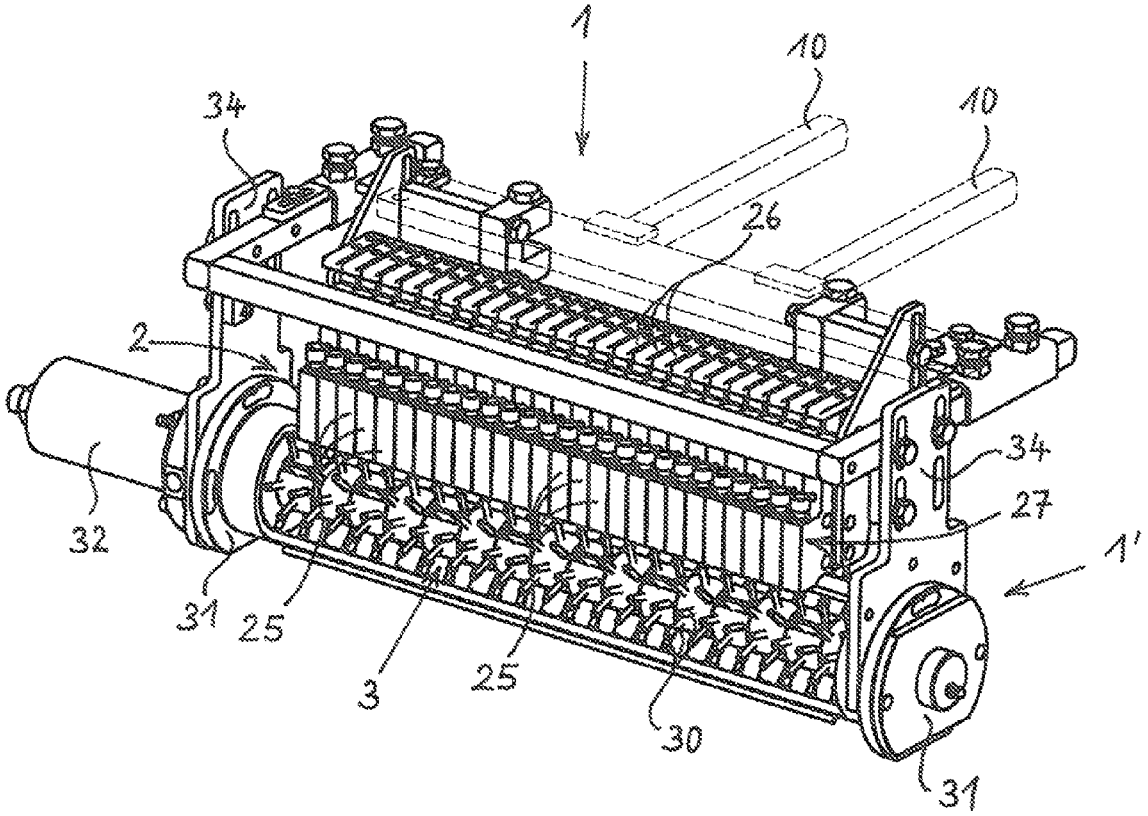
FIG. 2 shows the detail II of the device encircled in FIG. 1 in an enlarged perspective view.

In a perspective view, FIG. 2 of the drawing shows the part II of the device 1 from FIG. 1 comprising the material outlet 2 and the rotational body 3 in an enlarged illustration. In the upper part of FIG. 2, the material outlet 2 is visible, which is assembled from a plurality of nozzle elements 25, which are arranged next to one another and which form a nozzle arrangement 27 and which are in each case held on a nozzle support 26. The nozzle supports 26, in turn, are connected mechanically to a part of the frame 10 of the device 1 in a suitable manner.

Each nozzle element 25 has a discharge nozzle, which is oriented downwards and through which a material flow of marking material can in each case be discharged.

The rotational body 3, comprising its structural elements 30, in the form of a spiked roller herein, is attached to the remaining part of the device 1, here the frame 10, at an adjustable distance below the material outlet 2 by means of two lateral consoles 34, which run in vertical direction. At both of its ends, the rotational body 3 is rotatably supported in bearings 31. A drive 32, here a hydraulic motor, by means of which the rotational body 3 can be set into rotation, is attached to the left front side of the rotational body 3.

At least one material feed line, which is not visible herein and which is in flow connection with all of the nozzle elements 25, serves to feed the marking material. Each discharge nozzle in the different nozzle elements 25 can be opened or closed individually, so that a desired number of material flows of the marking material can be discharged. The width of the created marking, for example a marking line, can thus be adjusted easily.

Figure 3A:
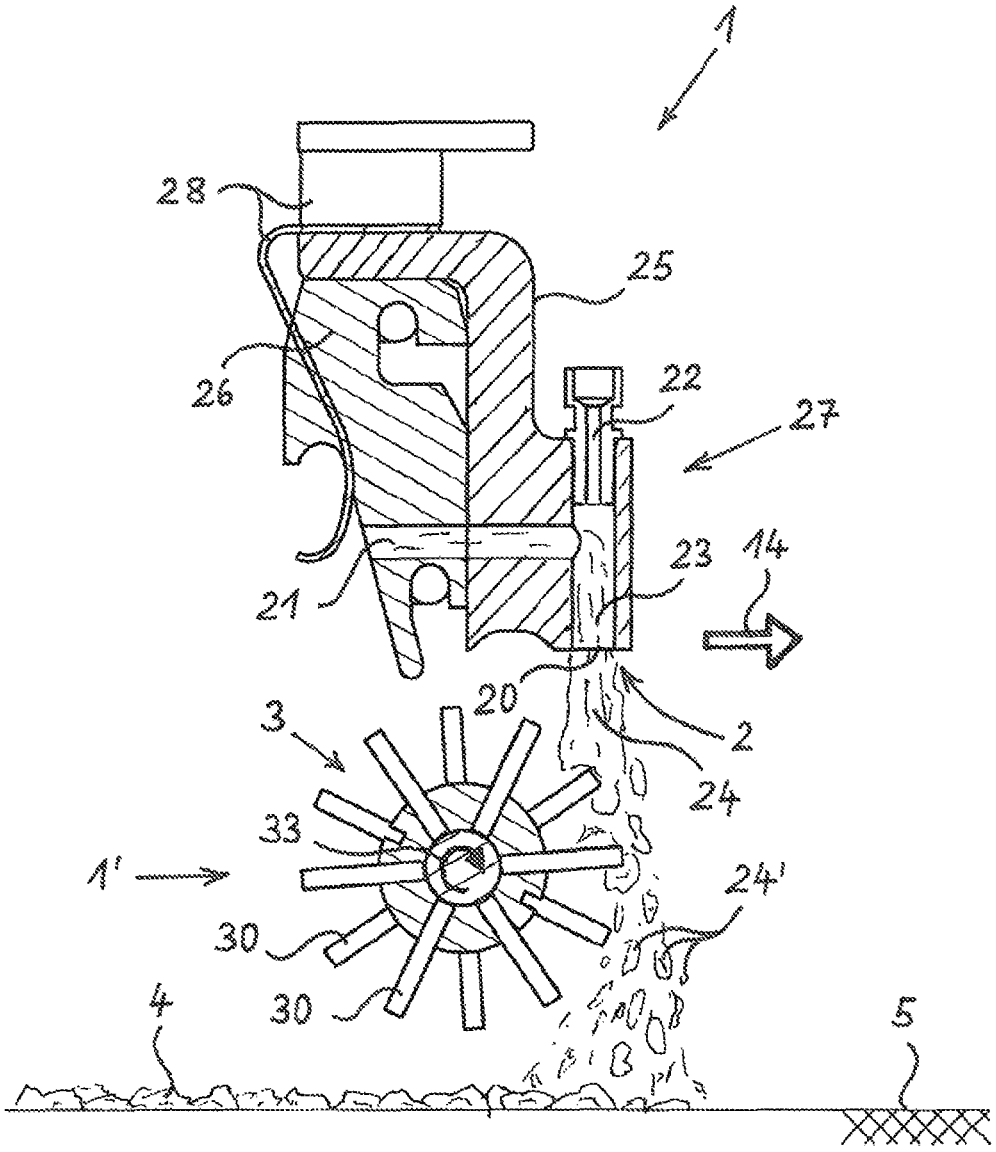
FIG. 3*a* shows the device part from FIG. 2 in a schematic cross section, comprising a first work flow direction.

FIG. 3*a* of the drawing shows the part of the device 1, which is illustrated in FIG. 2, in a vertical section. The nozzle arrangement 27, which comprises the nozzle elements 25, which are arranged downstream from one another vertically to the drawing plane, is illustrated on the top in FIG. 3*a*. A nozzle support 26 and a holder 28 comprising a holding spring are assigned to each nozzle element 25.

Marking material can be fed to the nozzle element 25, which is cut in FIG. 3*a*, through a material feed channel 21 and through a line, which is connected upstream and which is not illustrated herein, wherein the marking material is initially conveyed into a discharge nozzle 23, which encompasses an outlet opening 20 at the bottom. An air feed channel 22, to which compressed air can be fed via an air line, which is not illustrated herein, is connected to the upper end of the discharge nozzle 23. The compressed air can thereby be fed continuously or so as to pulsate or intermittently, whereby a continuous or pulsating or intermittent marking material flow is discharged accordingly through the outlet opening 20. This discharge process takes place during the operation of the device 1 in all of the or in selected nozzle elements 25, the arrangement of which vertically to the drawing plane of FIG. 3*a* form the nozzle arrangement 27.

The rotational body 3 comprising its spiky structural elements 30 is arranged below the nozzle elements 25 and can be driven in work flow direction according to the spinning arrow 33 by means of the rotary drive, which is shown and mentioned in FIG. 2. By rotating the rotational body 3, the structural elements 30 thereof divide the material flow 24 of the marking material, which escapes from each outlet opening 20, into irregular material portions 24' having different sizes, which then end up on the surface 5 and form the marking 4 comprising a stochastic material distribution at that location. Here, the device 1 thereby moves across the surface 5 in the direction of movement 14 from left to right in FIG. 3*a*, which is specified by an arrow.

Figure 3B:
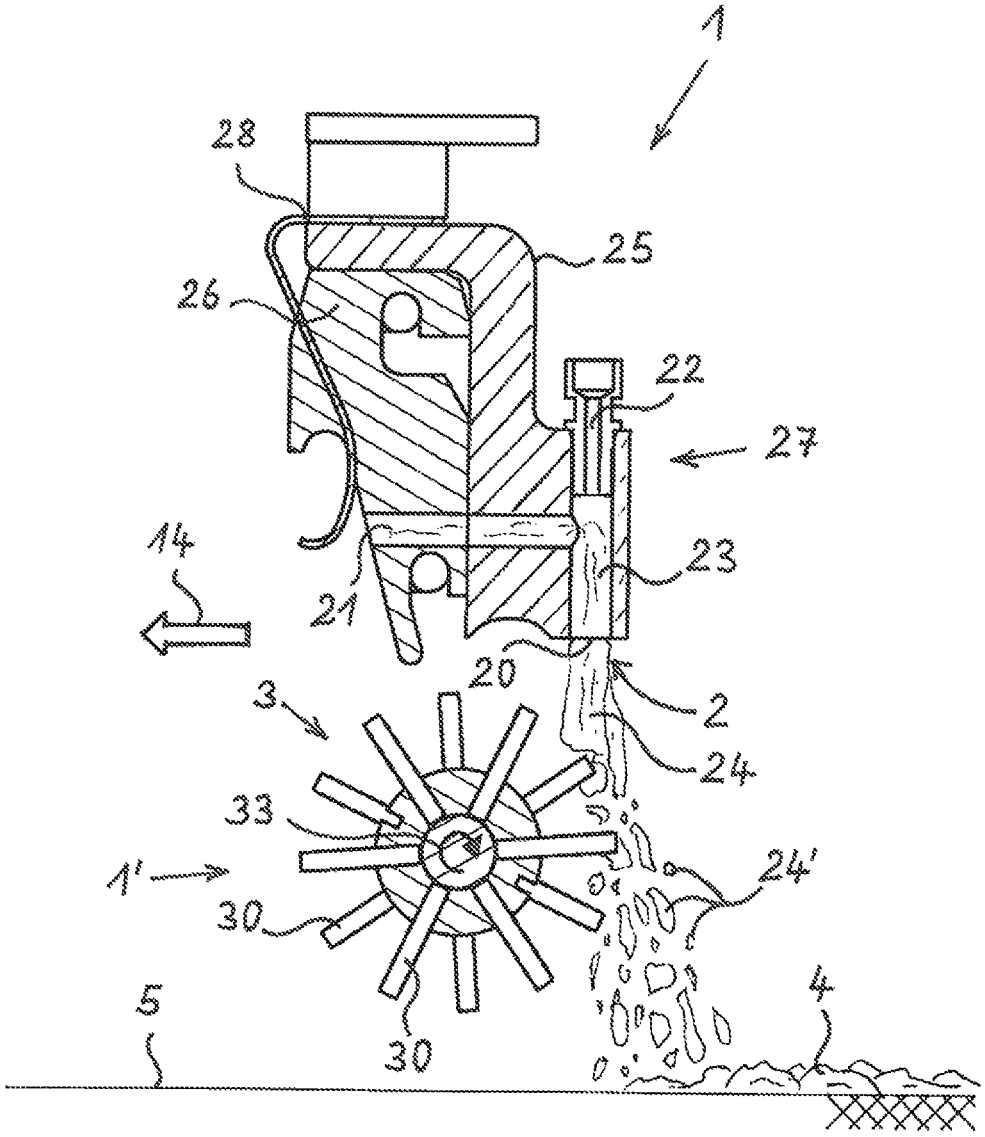
FIG. 3*b* shows the device part from FIG. 2 in a schematic cross section, comprising a second work flow direction.

According to FIG. 3*b* of the drawing, the device 1 can also encompass a work flow direction, which is opposite compared to the example in FIG. 3*a*. According to FIG. 3*b*, the part of device 1 shown in FIG. 2 can be assembled to the frame 10 of the device 1 opposite as in FIG. 3*a*. The device 1 in FIG. 3*b* thereby corresponds completely to the device 1 in FIG. 3*a* with regard to its parts, but is now moved in opposite direction according to the motion arrow 14 in FIG. 3*b*, that is, from right to left, during operation. During a first run in the one direction, the device 1 can also create a first marking and can then create a further marking during a second run in opposite direction of movement, without having to turn around. With regard to the further reference numerals in FIG. 3*b*, reference is made to the description of FIG. 3*a*.

By changing the speed of the rotational body 3 and by changing the position of the rotational body 3 relative to the material outlet 2, the effect of the rotational body 3 on the marking material flows 24 can be changed and adjusted as required. When a division of the material flows 24 by means of the rotational body 3 is not desired, the latter can be moved into a position, in which it no longer meets the material flows 24, or can be removed completely. As is illustrated in FIG. 2, the latter can be carried out quickly and easily by releasing the consoles 34 from the remaining device 1.

Figure 4:
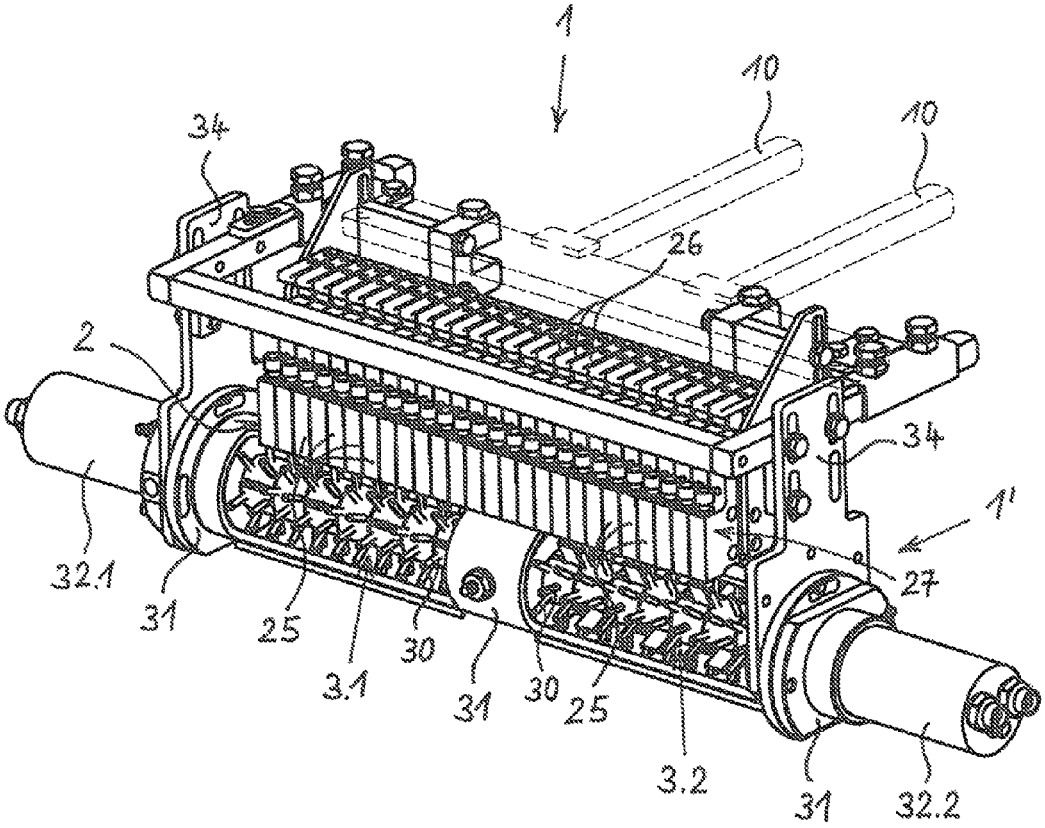
FIG. 4 shows the device part from FIG. 2 in a changed embodiment.
Figure 5:
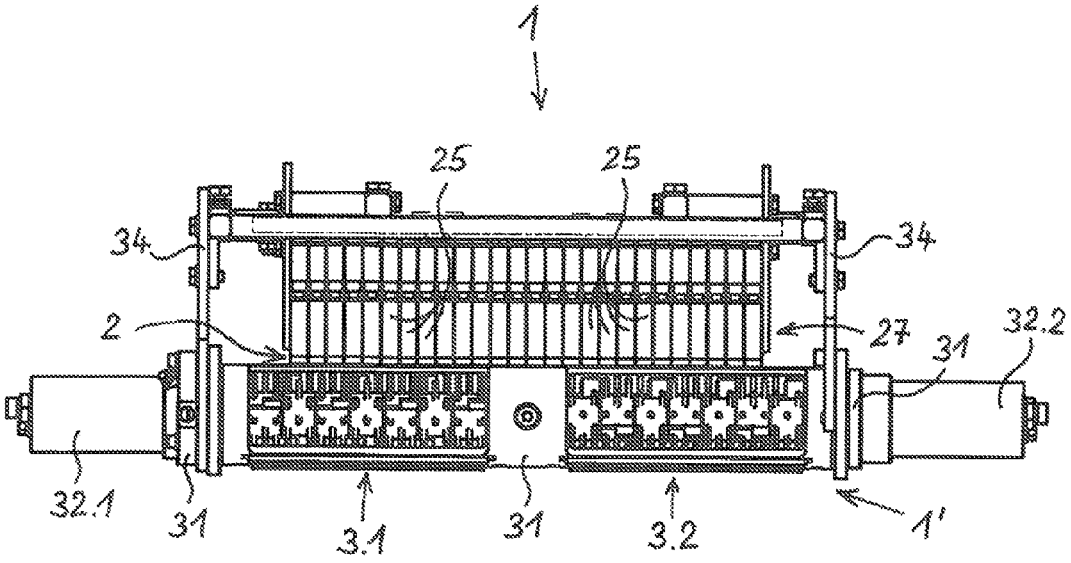
FIG. 5 shows the device part from FIG. 4 in a rear view and FIG. 6 shows the device part from FIG. 4 in a top view.
Figure 6:
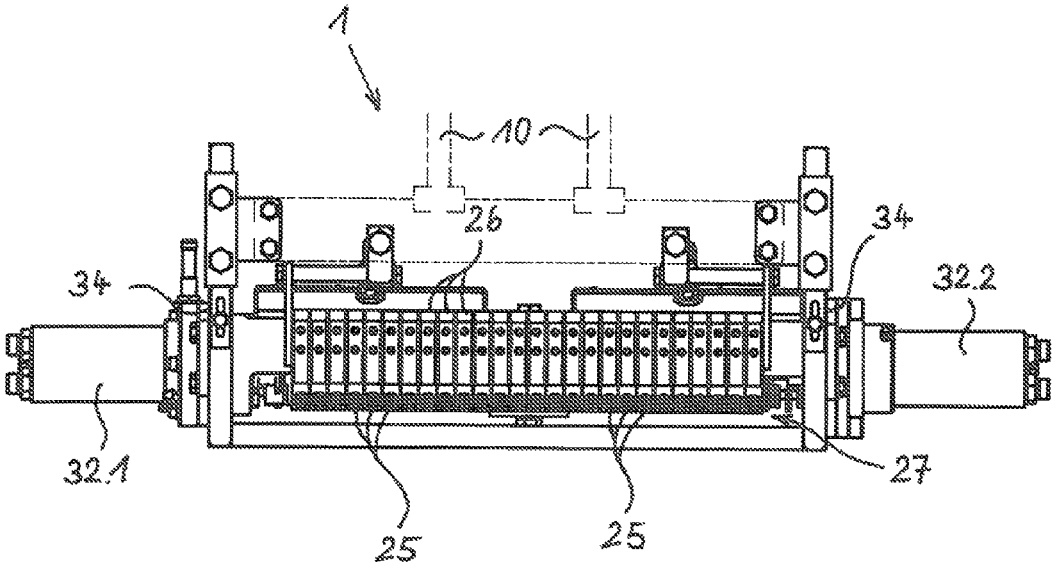

FIGS. 4 to 6 of the drawing illustrate a changed embodiment of the device 1, for which it is characteristic that it encompasses two rotational bodies 3.1 and 3.2, which are arranged next to one another and which can be rotated about the same axis of rotation, but independent from one another. The part of the device 1, which is arranged above the two rotational bodies 3.1, 3.2, corresponds herein to the above-explained embodiment, to the description of which reference is made.

At their respective inner front end, the two rotational bodies 3.1 and 3.2 are rotatably supported in a bearing 31 so as to capable of being uncoupled from one another. At its left end, the rotational body 3.1 on the left-hand side in FIG. 4 is supported in a further bearing 31 and is connected to a first drive 32.1, here also a hydraulic motor, at that location. At its right end, the right rotational body 3.2 is accordingly supported in a further bearing 31, and is connected to a second drive 32.2, also a hydraulic motor, at that location.

Double lines or combined lines can be created with the device 1 according to FIG. 4 with a high quality and high productivity. For example, two groups of material flows are discharged from two groups of nozzle elements 25 for creating a double line, wherein the one group is assigned to the first rotational body 3.1 and the second group, which is laterally spaced apart from the first group, is assigned to the second rotational body 3.2, so as to create two parallel, continuous marking lines. When a combined marking line, that is, a continuous line comprising a parallel broken line, is to be created, marking material is discharged continuously from the first group of nozzle elements 25, while marking material is discharged only periodically from the second group of nozzle elements 25, which are assigned to the second rotational body 3.2, so that a combination of a continuous line and a broken line, which runs parallel thereto, is created in this manner. The respective rotational body 3.1 or 3.2 is stopped in the gap lines, so as to prevent that the marking material residues, which are still located thereon, are spun off. In addition, the material residue, which adheres to a splash guard, which may be provided and which partially surrounds the rotational body 3.1, 3.2 and which is not illustrated in the drawing, can be blown back to the marking line, which is currently applied, by means of an air pulse from an air syringe.

As is further illustrated in FIG. 4, the part of the device 1, which comprises the rotational bodies 3.1, 3.2 as well as the bearings 31 and drives 32.1, 32.2 thereof, can be embodied as an additional unit 1', which can be attached and removed quickly, so that the device 1 can be modified quickly for different purposes. Without the rotational bodies 3.1, 3.2, the device 1 creates markings from a plurality of marking material points, which are identical and which are arranged regularly; by means of the rotational bodies 3.1, 3.2, the device 1 creates markings from unequal material portions comprising a stochastic material distribution.

FIG. 5 of the drawing shows the part of the device 1 from FIG. 4 in a rear view. The nozzle elements 25, which, strung together, form the nozzle arrangement 27, are located in the upper part, while the two rotational bodies 3.1 and 3.2 with their bearings 31 and their drives 32.1, 32.2 are visible in the lower part.

FIG. 6 shows the device part from FIGS. 4 and 5 in top view, wherein the view directed from the top onto the nozzle arrangement 27 comprising the nozzle elements 25, which are strung together and which are in each case held on a nozzle support 26. A part of the frame 10 of the device 1 is visible on the top in FIG. 6. The rotational bodies are covered herein and are not visible; only the two drives 32.1 and 32.2 are visible on the left and on the right in FIG. 6.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCE NUMERALS

| Numeral | Designation |
|---|---|
| 1 | device |
| 1' | additional unit |
| 10 | frame |
| 11 | wheels |
| 12 | storage container for marking material |
| 13 | conveying device (metering pump) |
| 14 | direction of movement of 1 |
| 15 | driver's cab |
| 16 | storage container for glass beads |
| 2 | material outlet |
| 20 | outlet openings |
| 21 | material feed channel |
| 22 | air feed channel |
| 23 | discharge nozzle |
| 24 | material flows |
| 24' | material portions |
| 25 | nozzle elements |
| 26 | nozzle support |
| 27 | nozzle arrangement |
| 28 | holder |
| 3, 3.1, 3.2 | rotational bodies (spiked roller) |
| 30 | structural elements (spikes) |
| 31 | bearings |
| 32, 32.1, 32.2 | drives |
| 33 | rotational work flow direction |
| 34 | consoles |
| 4 | marking |
| 5 | surface |

The invention claimed is:

1. A device for creating markings on a surface which is to be marked, comprising:

at least one material storage container, a conveying device configured to convey marking material from the material storage container to a material outlet, and a rotational body arranged below the material outlet, the rotational body being configured to receive the marking material from the material outlet, to divide the marking material into unequal material portions, and to apply the marking material to the surface, the device being configured to be moved relative to the surface in a longitudinal direction of the marking, which is to be created, an axis of rotation of the rotational body running at right angles to the longitudinal direction of the marking, the material outlet comprising a plurality of outlet openings, which, viewed in a longitudinal direction of the rotational body, are arranged next to one another, and configured to feed the marking material to the rotational body in the form of a plurality of marking material flows, which, viewed in the longitudinal direction of the rotational body, flow next to one another, the outlet openings being discharge nozzles, through which the marking material is discharged continuously or so as to pulsate or intermittently in a pressurized manner, and the outlet openings being configured to individually selectively be in a condition of one of released or locked in accordance with the marking, which is to be created.

2. The device according to claim 1, wherein the outlet openings have a cross section that is one of round, oval, square or rectangular.

3. The device according to claim 1, wherein the rotational body comprises a first rotational body arranged below a first connected group of the outlet openings and a second rotational body, which can be rotated independent from the first rotational body, arranged below a second connected group of the outlet openings.

4. The device according to claim 3, wherein each of the first and second rotational bodies is provided with its own, individually controllable rotary drive.

5. The device according to claim 4, wherein the rotary drive is a hydraulic motor.

6. The device according to claim 1, wherein the rotational body is provided with structural elements in the form of a spiked roller.

7. The device according to claim 1, wherein a position of the rotational body can be adjusted relative to the material outlet, in one of:

displaced in a horizontal direction parallel to the direction of movement of the device, displaced in a vertical direction, or pivoted in a vertical plane.

8. The device according to claim 1, wherein the individual discharge nozzles are located in nozzle elements, which are removably attached individually to a nozzle support and which are configured to form a variable nozzle arrangement.

9. The device according to claim 8, wherein the individual nozzle elements are assembled at a selectively changeable lateral distance to one another so as to form the nozzle arrangement.

10. The device according to claim 1, wherein the conveying device comprises at least one metering pump.

11. The device according to claim 1, wherein the rotational body includes a rotational body support, and at least one rotational body drive is embodied as an additional unit which is removably mounted to the remaining device.

12. A combination of a device for creating markings on a surface which is to be marked and a marking material, comprising:

at least one material storage container for the marking material, a conveying device configured to convey the marking material from the material storage container to a material outlet, and a rotational body arranged below the material outlet, the rotational body being configured to receive the marking material from the material outlet, to selectively divide the marking material into unequal material portions, and to apply the marking material to the surface, the device being configured to be moved relative to the surface in a longitudinal direction of the marking, which is to be created, an axis of rotation of the rotational body running at right angles to the longitudinal direction of the marking, the material outlet being comprising a plurality of outlet openings, which, viewed in a longitudinal direction of the rotational body, are arranged next to one another, and configured to feed the marking material to the rotational body in the form of a plurality of marking material flows, which, view in the longitudinal direction of the rotational body, flow next to one another, the outlet openings being discharge nozzles, through which the marking material is discharged continuously or so as to pulsate or intermittently in a pressurized manner, and the outlet openings being configured to individually selectively be in a condition of one of released or locked in accordance with the marking, which is to be created.

13. The device according to claim 12, wherein the marking material is highly viscous.

14. The device according to claim 12, wherein the marking material is a two-component cold plastic.

15. The device according to claim 12, wherein the surface comprises a road surface.

* * * * *